US006131523A

United States Patent [19]

Crowley

[11] Patent Number: 6,131,523

[45] Date of Patent: Oct. 17, 2000

[54] RECONFIGURABLE APPARATUS FOR STORING AND DISPLAYING ITEMS

[75] Inventor: Michael W. Crowley, Eatonton, Ga.

[73] Assignee: Crowley's Caseworks, Inc., Eatonton, Ga.

[21] Appl. No.: 09/350,266

[22] Filed: Jul. 6, 1999

[51] Int. Cl.[7] ..... A47B 57/00

[52] U.S. Cl. ..... 108/96; 108/23; 108/107

[58] Field of Search ..... 108/23, 96, 95, 108/94, 92, 29, 42; 248/157, 161, 407, 125.1, 125.3; 211/107, 207, 190, 126.2, 128.1, 129.1, 131.1, 133.1, 187, 186, 163; 100/106, 107

[56] References Cited

U.S. PATENT DOCUMENTS

| | | | |
|---|---|---|---|
| 1,433,370 | 10/1922 | Goldsmith | 108/23 |
| 1,570,651 | 1/1926 | Topping et al. | 108/94 |
| 2,157,400 | 5/1939 | Cooper | 108/96 |
| 2,915,194 | 12/1959 | Shoffner | 108/95 X |
| 3,169,496 | 2/1965 | Muggli et al. | 108/94 |
| 3,640,498 | 2/1972 | Aleks | 108/96 X |
| 4,044,979 | 8/1977 | Lemmo | 248/407 X |
| 5,161,561 | 11/1992 | Jamieson | 108/94 X |

*Primary Examiner*—Jose V. Chen
*Attorney, Agent, or Firm*—Bernstein & Associates

[57] ABSTRACT

A post with a series of generally parallel grooves defined therein and at least one shelf received, engaged, and supported by any of the grooves. A support frame has a base, a top, and cross-members disposed within and generally coextensive with the tubular post. A generally elastic sheet is disposed about the post to generally conform to the post sidewall and generally cover the grooves.

An optional extension bar assembly has a collar receivable within any of the grooves and a bar with notches for receiving hangers. An optional connecting bar assembly has an elongated bar supported by two collars receivable within any of the grooves. Furthermore, there may be provided a holder for product information, and top and bottom housings mounted to the post with each containing a lighting assembly or the like.

31 Claims, 3 Drawing Sheets

RECONFIGURABLE APPARATUS FOR STORING AND DISPLAYING ITEMS

FIELD OF THE INVENTION

The present invention relates generally to store fixtures for displaying products, and more particularly, to a product display apparatus with shelves that can be configured in a variety of arrangements.

BRIEF DESCRIPTION OF THE PRIOR ART

Various retail and other industries commonly use apparatus for storing and displaying products. Such apparatus are generally referred to herein as store fixtures, and include but are not limited to cabinets, tables, stands, shelving and the like, for displaying many types of products such as garments, food, household items, sports gear, and the like, in a variety of businesses, for example, department stores, grocery stores, convenience stores, sporting goods stores, and the like.

It is generally of importance to retailers to have the capability of rearranging the store fixtures in their store in order to vary the size, shape and type of products displayed in accordance with the change of seasons, new product introductions, changing consumer preferences, changing of suppliers, and the like. It is therefore desirable to provide store fixtures that are versatile and adjustable so that they can be quickly and easily rearranged into a wide variety of configurations for displaying a wide variety of shapes and sizes of products.

Retailers generally desire such reconfiguration capability without compromising other desirable features of store fixtures. For example, retailers often prefer store fixtures to be aesthetically pleasing and/or decorative. Additionally, it is desirable for store fixtures to be generally lightweight and capable of quick and easy disassembly, movement, and re-assembly in a different configuration, yet to also be strong and structurally sound to avoid injury to customers and damage to goods. Furthermore, retailers generally desire to display their products efficiently including vertically to minimize the floor space occupied by a store fixture and thereby allow maximization of the quantity of products that can be displayed. Moreover, it is desirable for store fixtures to be generally simple in design and low in cost.

One type of known store fixture provides a conventional table or stand having a surface supported by legs. Another known store fixture provides conventional shelves supported by brackets mounted to a wall. These basic fixtures are limited in that they generally can not be reconfigured onto a wide variety of arrangements.

There is also known in the art the rotatable cabinet disclosed in U.S. Pat. No. 3,538,863 to Howard et al. This cabinet provides a central tubular post with an undercarriage and an opposed pair of holder devices mounted to the post. A plurality of partition walls are provided with slots for engaging hooks on the holder devices and with a plurality of rows of horizontal slots for supporting and coupling thereto sectional trays. The multiple rows of slots provide vertical adjustability of the trays, and the trays are selected to provide the desired radial extension from the central post. This cabinet is versatile and adjustable, however, because of the number component parts it is generally of limited benefit with regards to the desired features of quick and easy reconfiguration, relatively simple design, and generally low cost.

Additionally, there is known the picnic or patio table disclosed in U.S. Pat. No. 3,683,824 to Weber, which provides a cylindrical drum having a table top supported by one annular rib integrally formed on the drum. Two or more sectional tops may be provided and interconnected together. Also disclosed is the option of providing two annular clamping rings mounted to the drum with one ring positioned above the other and the top supported between the rings. This table is designed for use as a picnic table or patio table, and as such does not provide for a wide variety of configurations for displaying a wide variety of shapes and sizes of products.

Accordingly, what is needed but not found in the prior art is a display apparatus that may be quickly and easily rearranged into a wide variety of configurations, that is generally lightweight and capable of quick and easy disassembly, movement, and re-assembly in a different configuration, that is strong and structurally sound, that is aesthetically pleasing and/or decorative, and that is generally simple in design and low in cost.

SUMMARY OF THE INVENTION

Generally described, the present invention provides a display apparatus comprising a post having at least one sidewall with a series of generally parallel grooves defined therein. At least one shelf is provided with an opening defined therethrough and an inner portion generally adjacent to the opening. The inner portion is capable of being received, engaged, and supported by any of the grooves.

A first preferred embodiment of the present invention provides the post being generally cylindrical and the at least one shelf opening being generally centrally defined in the shelf and generally circular so as to substantially conform to the post. The grooves are formed generally continuously and peripherally around the post and are generally uniform in shape and size so that the at least one shelf is capable of being received, engaged, and supported by any of the grooves. Preferably, the shape of each of the grooves is generally rectangular although other regular or irregular shapes may be used. Each shelf is preferably made of two shelf segments which may be coupled together about the post.

There is preferably further provided a support frame having a base, a top, and at least one and preferably two radial cross-member disposed within and generally coextensive with the tubular post. The cross-member generally engage and buttress the inner walls of the grooves.

Additionally, there is preferably provided a generally elastic sheet disposed about the post to generally conform to the post sidewall and generally cover at least some of the grooves. The sheet is selected with the elasticity such that upon insertion of the shelf into any of the grooves the sheet is capable of deformation to generally conform to the shape of each groove and shelf inner portion, and upon removal of the shelf from the groove the sheet is capable of returning to its original shape generally conforming to the shape of the post sidewall.

Furthermore, there may be provided an optional extension bar assembly having a collar capable of being received by any of the grooves and removably attached to the post, with the collar having a bar with notches for receiving conventional hangers. Also, there may be provided an optional connecting bar assembly having a first collar and a second collar, each of the collars capable of being received by and removably attached to any of the grooves, and a generally elongated connecting bar capable of being removably attached to the collars.

A second preferred embodiment of the present invention provides a similar display apparatus as the first embodiment, and additionally comprises a holder or the like capable of receiving and displaying product information or the like. There is also provided at least one generally spherical and generally translucent housing associated with said post, with a decorative device generally arranged with said housing. Preferably, the decorative device is at least one lighting assembly connected to a conventional power.

For installation and use of the display apparatus, each shelf is positioned with the inner portion inserted into any of the grooves and the shelf segments are then coupled together whereby the sheet generally deforms into conformity with the shape of the inner portion and the groove so as to conceal the vacant grooves. The number, position, spacing, and diameter of the shelves may be selected to accommodate the desired storage and display of products or the like. Any number of optional extension bar assemblies and/or connecting bar assemblies may be mounted to the post as may desired.

When it becomes desirable to move the display apparatus or to store and/or display different products thereon, the apparatus may be quickly and easily reconfigured accordingly. The shelves may be decoupled and removed from the grooves and any optional extension bars assemblies and/or connecting bar assemblies may be detached from the post. The display apparatus may then be relocated to another site within the facility or to another facility for use therein. Re-assembly of the apparatus into a new configuration to accommodate the new products may then be accomplished by the procedures describe hereinabove.

Accordingly, it is an object of the present invention to provide a display apparatus that may be quickly and easily disassembled, moved, and reassembled into a wide variety of configurations to display a wide variety of shapes and sizes of products and that is of a simple design employing lightweight materials. This object is accomplished by generally providing a post having grooves defined therein for optional extension bars, connecting bars, and/or the like for use therewith.

It is another object to provide a display apparatus with a decorative and aesthetically pleasing appearance. This object is accomplished by generally providing an elastic sheet covering the post grooves that is deformable upon insertion of the shelves into the grooves to produce a uniform appearance of the apparatus, by optional locations for displaying product information or the like, and by optional lighting assemblies.

It is still another object to provide a display apparatus that is strong and structurally sound by generally providing a support frame for the post. It is a further object to provide a display apparatus that is generally low in cost by providing a simple design employing readily available materials and fabrication techniques.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
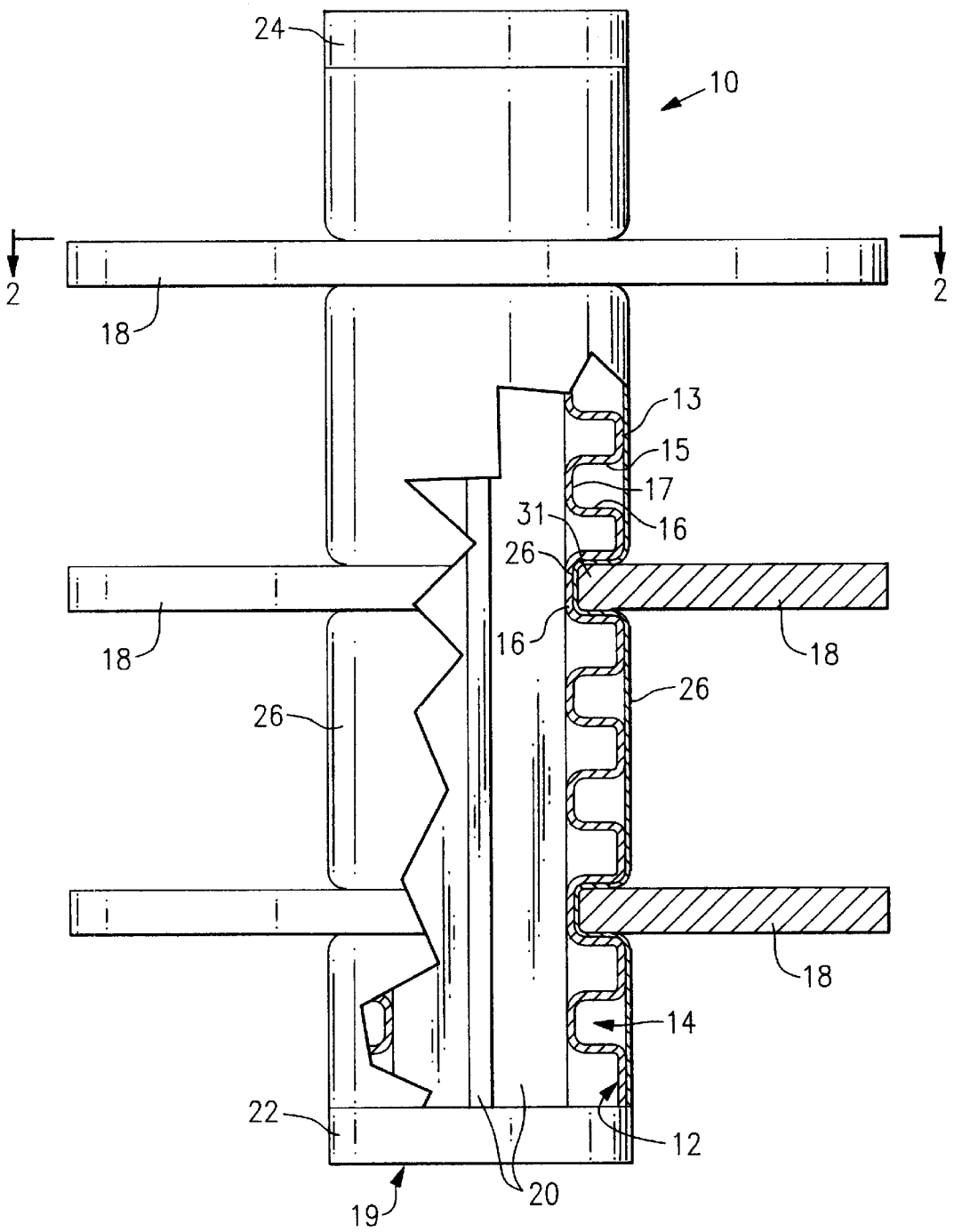
FIG. 1 is an elevation view of a first preferred embodiment of the present invention with a cutaway section thereof.
Figure 2:
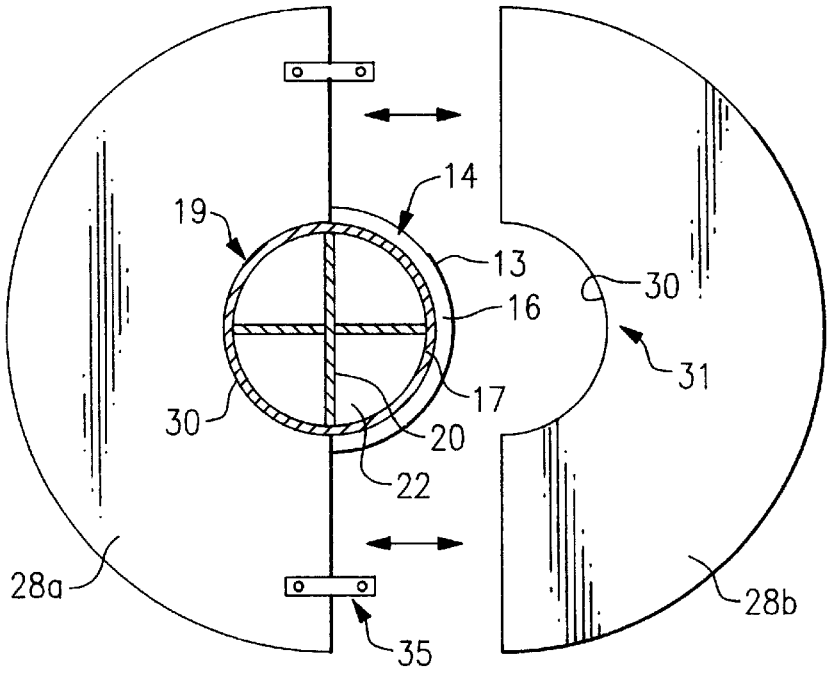
FIG. 2 is a top plan view taken at line 2—2 of FIG. 1.

Referring now to FIGS. 1 and 2, there is illustrated a first preferred embodiment of the present invention, referred to generally as a display apparatus 10. The display apparatus 10 comprises a post 12 having a sidewall 13 with a plurality of grooves 14 defined therein in a corrugated arrangement. The post 12 is preferably generally tubular and cylindrical with a length and diameter selected based on the desired size and stability of the apparatus 10 for a given application. Optionally, the post 12 may be have a rectangular, triangular, hexagonal, or other regular or irregular shape and/or may be comprised of a solid or substantially solid material as is known to those skilled in the art. The post 12 is preferably made of high density polyethelene (HDPE), which HDPE posts are readily commercially available. Optionally, other materials may be suitably employed such thermoplastic resins, metals, wood, composites, and other materials selected for light weight, high strength, and low cost as are known to those skilled in the art.

The grooves 14 are each preferably formed by two opposing walls 15 and 16 and an inner wall 17 at a depth relative to the sidewall 12 such that each of the grooves 14 may removably receive, engage, and support a shelf 18. The shape of the grooves 14 is preferably generally rectangular, but optionally may be any regular or irregular shape to mate with the shape of the shelf 18. The grooves 14 are each preferably generally uniform in shape and size so that the shelves 18 are interchangeable and capable of being received, engaged, and supported by any of the grooves 14. It is to be understood, however, that the shelves 18 can be of different shapes, sizes, colors, or the like for different aesthetic or functional purposes. The number and spacing of the grooves 14 may be selected to provide any desired number of positions on the post 12 for mounting the shelves 18. Each groove 14 is annular and extends substantially circumferentially around the periphery of the post 12. Optionally, the grooves 14 may have tabs or the like for being received in tabs or the like on the shelves 18 for aligning the shelves 18 in a desired orientation, or the grooves 14 may extend only partially around the post 12 with the shelves 18 shaped accordingly. Additionally, in another option each groove 14 has at least one sub-groove defined in at least one wall 15, 16, 17 and capable of aligning and receiving at least one protrusion extending from each shelf 18, for providing increased strength and stability.

In order to maximize the capability of arranging the shelves 18 in a wide variety of positions on the post 12 without compromising the strength of the post 12, a relatively large number of grooves 14 at a relatively small spacing may be provided without compromising the strength of the post 12. To ensure the stability and strength of the apparatus 10, however, it is preferable to provide a support frame 19 therefor.

The support frame 19, shown in cross-section in FIG. 2, preferably comprises at least one and preferably a plurality of radial cross-members 20 or the like disposed within and generally coextensive with the post 12, and generally engaging and buttressing the inner walls 17 of the grooves 14. Optionally, the support frame may have a solid body disposed within the post 12 and conforming to the grooved shape of the post so that there are substantially no gaps therebetween, where such solid body may be provided by a material that may be poured or injected into the post 12 where it may solidify into an at least semi-rigid body. Other support frames 19 may be suitably employed, for example, with the post 12 and the support frame 19 provided as a single member of an integrated construction, with the support frame 19 having biased extensions that may pivot to a generally horizontal position to engage and support the bottom walls 16 of the grooves 14, and other support apparatus known to those skilled in the art.

The support frame 19 preferably further comprises a base 22 and a top 24 attached to the cross-members 20. The base 22 may substantially cover the bottom of the post 12 and is preferably sufficiently large and/or sufficiently heavy or weighted to stabilize the apparatus 10 even when heavily and/or unevenly loaded with products. The base 12 may optionally have casters, bearings, rollers, or other mechanisms attached thereto providing or facilitating a rolling or other moving capability for the display apparatus 10. The top 24 may substantially cover the top end of the post 12 to generally seal the inside of the post 12 and is preferably sufficiently large to serve as a top shelf where desired. The base 22 and top 24 are preferably circular to generally conform to the preferred shape of the post 12, thought optionally any regular or irregular shape may be suitably employed. The base 22 and top 24 are preferably provided as solid members, but optionally may be hollow, recessed, filled with a material, or have other constructions known to those skilled in the art.

The support frame 19 components may be made of wood, fiberboard, metal, thermoplastic resins, melamine, composites, and/or other materials known to those skilled in the art. It should be noted that in some applications, particularly those involving limited loading from products to be displayed thereon, it may be desirable to provide the display apparatus 10 without a support frame 19.

A generally elastic sheet 26 (shown in FIG. 1) is preferably disposed about the post 12 to generally conform to the shape of the post walls 13 and generally cover the grooves 14. The sheet 26 is preferably made of spandex or a like elastic material. Optionally, other generally elastic materials including rubber, ductile plastic, woven fabrics, nonwoven fabrics, synthetic fibers, natural fibers, composites, and other materials known to those skilled in the art may be suitably employed.

The sheet 26 elasticity is such that upon insertion of the shelves 18 into the grooves 14, the sheet 26 is capable of sufficient stretching and/or deformation to generally conform to the shape of each groove 14 and shelf 18, and sufficient memory such that upon removal of the shelves 18 from the grooves 14, the sheet 26 is capable of returning to at least a portion of its original shape generally conforming to the shape of the post walls 13. The sheet 26 may thereby conceal the grooves to produce a generally uniform and aesthetically pleasing appearance of the display apparatus 10.

The sheet 26 is preferably removably attached to the post 12, for example by folding the sheet 26 under the base 22 and top 24, by sizing the sheet 26 to provide a snug fit to the post 12, or by other removable attachment techniques known to those skilled in the art. The sheet 26 may then be readily removed and replaced to customize the appearance of the display apparatus 10 as desired in a given application, further enhancing the versatility of the apparatus 10. Various color and/or texture sheets may be used selected to correspond to product marketing themes, seasonal promotions, and the like, such as red, white and blue for product displays around the Fourth of July holiday.

The shelves 18 may be made of wood, fiberboard, metal, thermoplastic resins, melamine, composites, and/or other materials known to those skilled in the art and selected for high strength and low weight. A decorative coating of paint, fabric, and/or the like may be applied to the shelves 18 and also to the base 22, the top 24, and the post 12 where the sheet 26 is not employed. The shelves 18 may be provided with a variety of radii to provide a variety of configurations of the apparatus 10, as shown more clearly in FIG. 8 of the second embodiment.

Each shelf 18 is preferably generally circular with a generally circular opening 30 centrally defined therethrough and an inner portion 31 that is generally adjacent to the opening 30. Optionally, the shelf 18 may be rectangular, triangular, hexagonal, or other regular or irregular shapes known to those skilled in the art. Also, the opening 30 may optionally be provided off-center, as a recess such that the shelf is in the shape of a semi-circle or the like, or in other arrangements.

The opening 30 is preferably circular or otherwise shaped to generally conform to the shape of the post 12 (see FIG. 2). The opening 30 preferably has a radius such that the inner portion 31 may be snugly received within the grooves 14 by a friction fit. The profile of the inner portion 31 is preferably generally rectangular to conform to the generally rectangular profile of the groove 14 (see FIG. 1), such that the inner portion 31 is engaged, supported, and generally prevented from vertical movement by the top and bottom walls 15 and 16 of the grooves 14, and is engaged and generally prevented from horizontal movement by the inner walls 17 of the grooves 14. Optionally, the profile of the inner portion 31 may have a curvature, may have one or more protrusions or the like extending therefrom and capable of aligning and being received by sub-grooves or the like defined in the grooves 14, and/or may have any other regular or irregular shape. In another option, a generally resilient ring member made of plastic, rubber, composites, or the like extends generally inward from the inner portion 31, such that the shelf 18 may be slid downward over the post 12 with the resilient member slightly deformed thereby but will return to its normal shape upon fitting into a groove 18.

Figure 3:
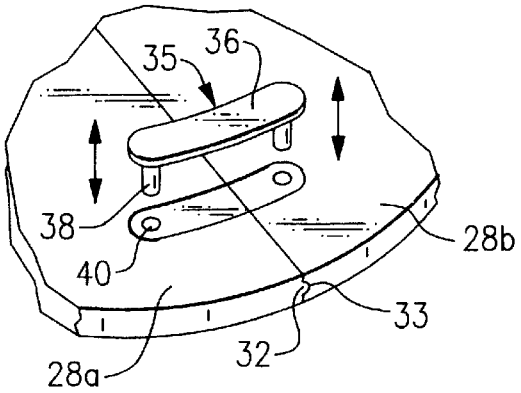
FIG. 3 is a detail perspective view of shelves and connectors therefor.
Figure 4:
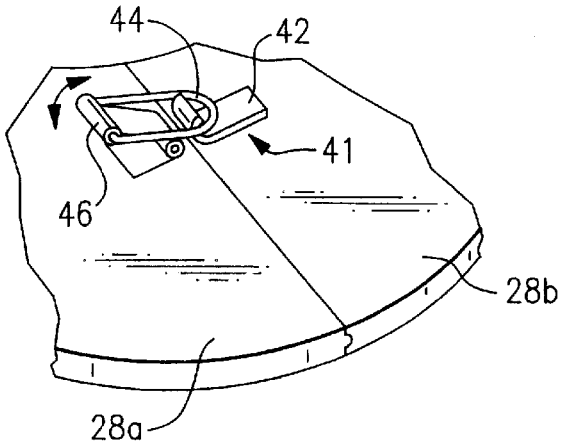
FIG. 4 is detail perspective view of shelves and alternative couplings therefor.

Referring now to FIGS. 2–4, each shelf 28 is preferably comprised of at least two shelf segments 28*a* and 28*b* which may be coupled together about at least a portion of the post 12. The shelf segments 28*a* and 28*b* may have a tongue 32 and a groove 34 formed thereon for cooperative engagement to provide added strength of the shelves 28 and to generally prevent or reduce deflection of one of the shelf segments 28*a* relative to the other shelf member 28*b* when subjected to a weight such as display merchandise.

The shelf segments 28*a* and 28*b* are preferably coupled together by a removable connector 35 comprising a plate 36 with at least two pins 38 extending therefrom capable of being aligned with and received by at least two apertures 40 defined at least one each on the shelf segments 28*a* and 28*b*. Another option, as illustrated in FIG. 4, provides a locking mechanism 41 comprising a hook 42 mounted to shelf member 28*b* and capable of engaging a loop 44 attached to a pivotal member 46 attached to shelf member 28*a*. It should be noted that a bracket, clamp, hasp, latch, hook and loop fastener, or other coupling mechanism and/or fastener known to those skilled in the art may be suitably employed.

Figure 5:
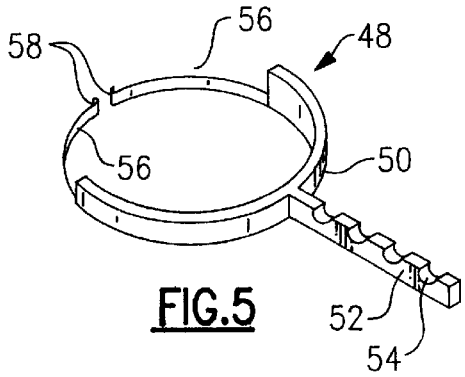
FIG. 5 is a perspective view of an optional extension bar assembly for use with the present invention.

Referring now to FIG. 5, there is provided an optional extension bar assembly 48 having a generally curved collar 50 with a bar 52, rod, or the like extending therefrom. The bar 52 preferably has at least one notch 54 defined therein for receiving garment hangers or the like. There are preferably attached to the collar 50 at least one strap 56 or the like with at least one conventional fastener mechanism 58 such as a snap, button, clip, latch, hook and loops fastener, adhesive, magnet, or the like, whereby the collar 50 may be strapped into any of the grooves 14 of the post 12.

Figure 7:
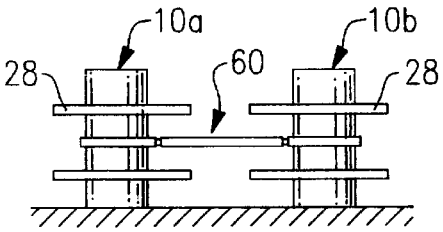
FIG. 7 is an elevation view of the connecting bar assembly mounted on the present invention.
Figure 6:
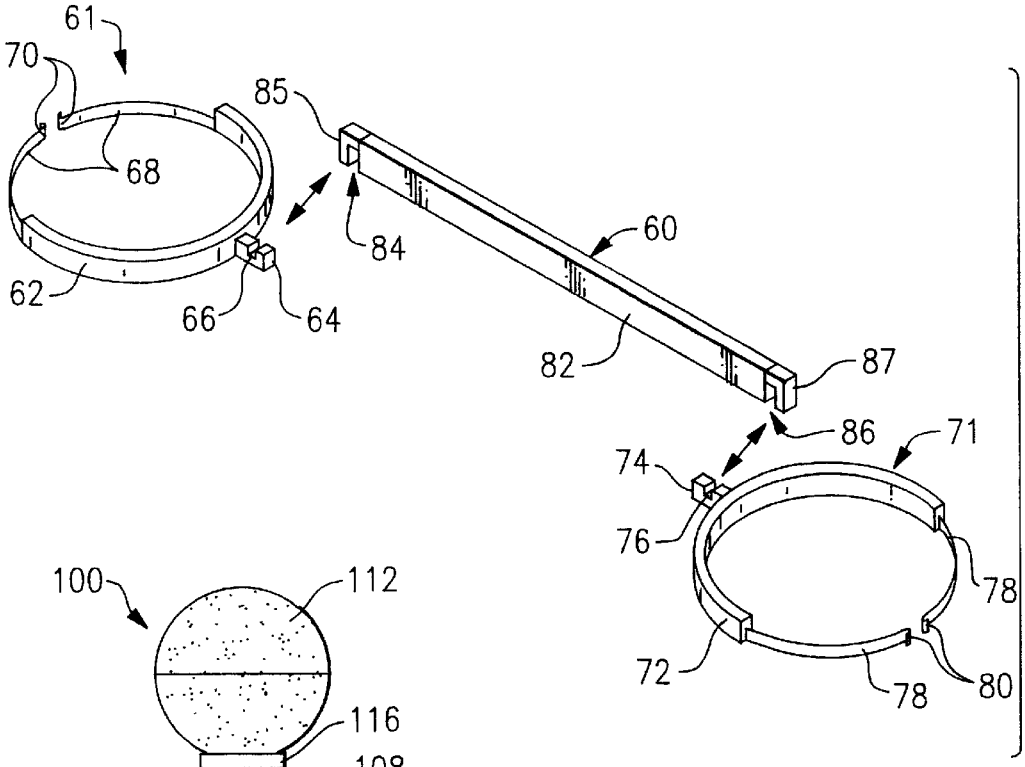
FIG. 6 is a perspective view of an optional connecting bar assembly for use with the present invention.

Referring now to FIGS. 6–7, there is provided an optional connecting bar assembly 60 preferably comprising a first collar 61 having a generally curved segment 62 with an arm 64 extending therefrom, the arm 64 preferably having at least one notch 66 defined in the top surface of the arm 64. The segment 62 has attached thereto at least one strap 68 with at least one conventional fastener mechanism 70 such as a snap, button, clip, latch, hook and loops fastener, adhesive, magnet, or the like. A second collar 71 comprises a generally curved segment 72 with an arm 74 extending therefrom, the arm 74 preferably having at least one notch 76 defined in the top surface of the arm 74. The segment 72 has attached thereto at least one strap 78 with at least one conventional fastener mechanism 80 such as a snap, button, clip, latch, hook and loops fastener, adhesive, magnet, or the like. A generally elongated connecting bar 82 has a first notch 84 formed by a downwardly protruding finger 85 and a second notch 86 formed by a downwardly protruding finger 87, such that the notches 84 and 86 are capable of being received, engaged, and supported by the notches 66 and 76. Optionally, the notches 66 and 76 may be provided on the bar 82 and the notches 84 and 86 may be provided on the segments 62 and 72, or other removable attachment arrangements known to those skilled in the art may be provided.

The segment 62 may thereby be strapped into any of the grooves 14 of the post 12 of a first display apparatus 10*a* and the segment 72 may be strapped into the horizontally corresponding groove 14 of the post 12 of a second display apparatus 10*a* (see FIG. 7), with the connecting bar 82 then coupled to the arms 64 and 74 so as to be suspended between the display apparatus 10*a* and 10*b* for hanging garments or the like therefrom.

For installation and use of the display apparatus 10, each shelf 18 is positioned with the inner portion 31 inserted into any of the grooves 14 and the shelf segments 18*a* and 18*b* are then coupled together. The elasticity of the sheet 26 permits deformation thereof in conformity with the shape of the inner portion 31 and the groove 14 so as to conceal the vacant grooves 14, thereby providing a generally seamless and aesthetically pleasing appearance to the display apparatus 10.

The number, position, spacing, and diameter of the shelves may be selected to accommodate the desired storage and display of products or the like. The shelf diameters 18 may be selected to provide a variety of product display arrangements, for example, the shelves 18 may be configured in a tapered arrangement with lager diameter shelves 18 lower on the post 12 and smaller diameter shelves 18 higher on the post 12 for providing ease of access to products on higher shelves. Other arrangements of varying diameter and spacing of shelves 18 may be readily configured as may be desired. Also, any number of optional extension bar assemblies 48 and/or connecting bar assemblies 60 may be mounted to the post 12 as may desired.

When it becomes desirable to move the display apparatus 10 or to store and/or display different products thereon, the apparatus 10 may be quickly and easily reconfigured accordingly. The shelves 18 may be decoupled and removed from the grooves 14 and any optional extension bars assemblies 48 and/or connecting bar assemblies 60 may be detached from the post 12. The display apparatus 10 may then be relocated to another site within the facility or to another facility for use therein. Re-assembly of the apparatus 10 into a new configuration to accommodate the new products may then be accomplished by the procedures describe hereinabove.

Figure 8:
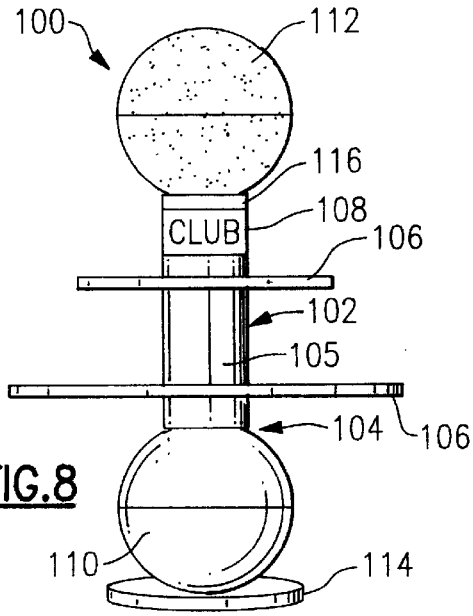
FIG. 8 is an elevation view of a second preferred embodiment of the present invention; and, FIG. 9 is a detail plan view of an optional lighting fixture for use with the present invention.

Referring now to FIG. 8, there is illustrated a second preferred embodiment 100 of the present invention which comprises a post 102, support frame 104, sheet 105, and shelves 106 similar to the first preferred embodiment 100. A holder 108 is preferably provided for holding and displaying product and/or brand indicia, pricing information, or the like. The holder 108 may be provided by a generally clear pocket with an open top for inserting therein such indicia or the like.

There are preferably provided at least one and preferably two decorative housings 110 and 112. The housings 110 and 112 are preferably generally spherical, though other regular or irregular shapes may be suitably employed. The housing 110 may be disposed about the support frame 104 and/or the post 102 generally adjacent to and supported by the base 114. The housing 112 may be attached to and supported by the top 116.

Figure 9:
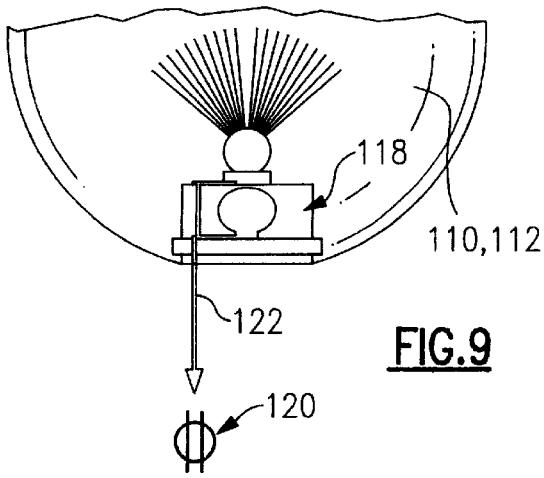

Referring now to FIG. 9, the housings 110 and 112 are preferably made of a generally translucent material such as a thermoplastic resin, glass, or the like, and have at least decorative device disposed therein such as a lighting assembly 118 connected to a conventional power source 120 by electric wires 122 or the like. The power source may be provided as batteries, 120/240 VAC, or the like. The lighting assembly 118 may provide a variety of decorative and aesthetic functions including but not limited to providing colored lighted, intermittent bursts of light, combination thereof, and other lighting techniques known to those skilled in the art. Where the post 12 is provided with a tubular construction, the electrical wiring 122 may be routed internally through the tubular post 12. The same installation and use procedures and benefits of the first embodiment 10 apply to second embodiment 110.

Accordingly, there are a number of advantages provided by the present invention. The post 10 has grooves 14 formed therein for removably receiving, engaging, and supporting shelves 18, extension bar assemblies 48, and/or connecting bar assemblies, thus providing the advantage of a display apparatus that may be quickly and easily disassembled, moved, and reassembled into a wide variety of configurations to display a wide variety of shapes and sizes of products and that is of a simple design employing lightweight materials.

Additionally, the generally elastic sheet 18 covers the post grooves 14 and is deformable upon insertion of the shelves 18, extension bar assemblies 48, and/or connecting bar assemblies into the grooves 14, thus producing a uniform, seamless, and aesthetically pleasing appearance to the apparatus 10. Also, the optional holders 106 for indicia and the optional housings 110 and 112 with lighting assemblies 118 provide additional decorative and aesthetic benefits.

Furthermore, the support frame 19 is provided for the post 12 which may be provided by commercially available HDPE pipe, providing the advantage of a display apparatus that is strong and structurally sound and readily made at a low cost from commercially available materials.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A display apparatus comprising:

a) a post having at least one sidewall with a series of generally parallel grooves defined therein and extending substantially all the way about said post in a corrugated arrangement; and b) at least one shelf having an opening defined therethrough and an inner portion generally adjacent to and extending substantially all the way along said opening, substantially all of said inner portion capable of being received, engaged, and supported by any of said grooves.

2. The apparatus of claim 1, wherein said post is generally cylindrical and said at least one shelf opening is generally centrally defined in said shelf and generally circular so as to substantially conform to said post.

3. The apparatus of claim 1, wherein said post sidewall is generally annular and said grooves extend substantially circumferentially around the periphery of said post.

4. The apparatus of claim 1, wherein each of said grooves is generally uniform in shape and size so that said at least one shelf is capable of being received, engaged, and supported by any of said grooves.

5. The apparatus of claim 4, wherein said shape of each of said grooves is generally rectangular.

6. The apparatus of claim 1, further comprising a support frame associated with said post, said support frame having a base.

7. The apparatus of claim 6, wherein said post is generally tubular, and further comprising at least one radial cross-member disposed within and generally coextensive with said tubular post, said cross-member generally engaging and buttressing inner walls of said grooves.

8. The apparatus of claim 6, wherein said support frame further comprises a top associated with said post.

9. The apparatus of claim 1, further comprising a generally elastic sheet disposed about said post to generally conform to said post sidewall and generally cover at least some of said grooves.

10. The apparatus of claim 1, wherein said sheet has an elasticity selected such that upon insertion of said shelf into any of said grooves said sheet is capable of deformation to generally conform to said shape of each groove and shelf inner portion, and upon removal of said shelf from said groove said sheet is capable of returning to its original shape generally conforming to said shape of said post sidewall.

11. The apparatus of claim 1, wherein said at least one shelf comprises a plurality of shelves each having a generally uniform opening and inner portion, wherein said shelves may have different radii.

12. The apparatus of claim 1, wherein said at least one shelf comprises at least two shelf segments which may be coupled together about said post.

13. The apparatus of claim 1, further comprising an extension bar assembly having a collar capable of being received by any of said grooves and removably attached to said post, said collar having a bar extending therefrom.

14. The apparatus of claim 1, further comprising a connecting bar assembly comprising a first collar and a second collar, each of said collars capable of being received by and removably attached to any of said grooves, and a generally elongated connecting bar capable of being removably attached to said first and second collars.

15. The apparatus of claim 1, further comprising a holder for indicia associated with said post.

16. The apparatus of claim 1, further comprising at least one housing associated with said post.

17. The apparatus of claim 16, further comprising a base associated with said post, and wherein said housing is arranged generally adjacent to and supported by said base.

18. The apparatus of claim 16, further comprising a top associated with said post, and wherein said housing is arranged generally adjacent to and supported by said top.

19. The apparatus of claim 16, wherein said housing is generally spherical.

20. The apparatus of claim 16, wherein said housing is made of a generally translucent material, and further comprising a decorative device generally arranged with said housing.

21. The apparatus of claim 20, wherein said decorative device comprises at least one lighting assembly, and further comprising a power source electrically connected to said lighting assembly.

22. A display apparatus comprising:

a) a generally tubular post having at least one sidewall with a series of generally parallel grooves defined therein in a corrugated arrangement, each of said grooves extending substantially circumferentially around the periphery of said post, each of said grooves having a generally uniform shape and size;

b) at least one generally circular shelf comprising two shelf segments which may be coupled together about said post, said shelf having a generally central opening defined therethrough so as to substantially conform to said post and a generally arcuate inner portion generally adjacent to said opening, said inner portion capable of being received, engaged, and supported by any of said grooves;

c) a generally elastic sheet disposed about said post to generally conform to said post sidewall and generally cover said grooves, wherein said elasticity is such that upon insertion of said shelf into any of said grooves said sheet is capable of deformation to generally conform to said shape of each groove and shelf inner portion, and upon removal of said shelf from said groove said sheet is capable of returning to its original shape generally conforming to said shape of said post sidewall; and, d) a support frame associated with said post, said support frame having a base, a top, and at least one radial cross-member disposed within and generally coextensive with said tubular post, said cross-member generally engaging and buttressing inner walls of said grooves.

23. The apparatus of claim 22, wherein said shape of each of said grooves is generally rectangular.

24. The apparatus of claim 22, further comprising an extension bar assembly having a collar capable of being received by any of said grooves and removably attached to said post, said collar having a bar extending therefrom.

25. The apparatus of claim 22, further comprising a connecting bar assembly comprising a first collar and a second collar, each of said collars capable of being received by and removably attached to any of said grooves, and a generally elongated connecting bar capable of being removably attached to said first and second collars.

26. The apparatus of claim 22, further comprising a holder capable of receiving indicia associated with said post.

27. The apparatus of claim 22, further comprising at least one generally spherical and generally translucent housing associated with said post, and further comprising a decorative device generally arranged with said housing.

28. The apparatus of claim 27, wherein said decorative device comprises at least one lighting assembly, and further comprising a power source electrically connected to said lighting assembly.

29. A display apparatus comprising:

a) a post having at least one sidewall with a series of generally parallel grooves defined therein in a corrugated arrangement;

b) at least one shelf having an opening defined therethrough and an inner portion generally adjacent to said opening, said inner portion capable of being received, engaged, and supported by any of said grooves; and c) a generally elastic sheet disposed about said post to generally conform to said post sidewall and generally cover at least some of said grooves.

30. The apparatus of claim 29, wherein said elastic sheet has an elasticity selected such that upon insertion of said shelf into any of said grooves said sheet is capable of deformation to generally conform to said shape of each groove and shelf inner portion, and upon removal of said shelf from said groove said sheet is capable of returning to its original shape generally conforming to said shape of said post sidewall.

31. A display apparatus comprising:

a) a post having at least one sidewall with a series of generally parallel grooves defined therein and extending substantially all the way about the post in a corrugated arrangement; and b) at least one shelf comprising at least two shelf segments capable of being coupled together about said post, said shelf having an opening defined therethrough so as to substantially conform to said post and an inner portion generally adjacent to and extending substantially all the way about said opening, substantially all of said inner portion capable of being received, engaged, and supported by any of said grooves.

* * * * *